US010145124B2

(12) United States Patent
Tosolini

(10) Patent No.: US 10,145,124 B2
(45) Date of Patent: Dec. 4, 2018

(54) MODULAR PANELS FOR MAKING AN INSTALLABLE / REMOVABLE TEMPORARY FLOOR AND METHOD FOR MAKING SAID FLOOR

(71) Applicant: EPS ITALIA SRL, Tavagnacco (IT)

(72) Inventor: Luca Tosolini, Tavagnacco (IT)

(73) Assignee: EPS ITALIA SRL, Tavagnacco (IT)

( * ) Notice: Subject to any disclaimer, the term of this patent is extended or adjusted under 35 U.S.C. 154(b) by 0 days.

(21) Appl. No.: 15/619,161

(22) Filed: Jun. 9, 2017

(65) Prior Publication Data

US 2017/0356192 A1 Dec. 14, 2017

(30) Foreign Application Priority Data

Jun. 10, 2016 (IT) ..... 102016000059918

(51) Int. Cl.
*E04F 15/024* (2006.01)
*E01C 5/00* (2006.01)
*E01C 9/08* (2006.01)

(52) U.S. Cl.
CPC ..... *E04F 15/02405* (2013.01); *E01C 5/005* (2013.01); *E01C 9/086* (2013.01)

(58) Field of Classification Search
CPC ..... E04F 15/02405; E04F 2201/05; E04F 2201/0505; E04F 2201/0517; E01C 5/005; E01C 9/086
USPC ..... 52/582.1, 585.1, 403.1, 177, 180
See application file for complete search history.

(56) References Cited

U.S. PATENT DOCUMENTS 4,577,448 A * 3/1986 Howorth ..... E01O 5/005 403/408.1
4,697,294 A * 10/1987 Schafer ..... E01C 5/005 14/69.5
5,511,353 A * 4/1996 Jones ..... E01O 5/005 52/236.1
5,685,666 A * 11/1997 Marshall ..... E01C 5/005 403/293

(Continued)

FOREIGN PATENT DOCUMENTS

DE 19600318 C1 4/1997
DE 20302434 U1 5/2003
WO WO-97/18353 A1 5/1997

OTHER PUBLICATIONS

Machine translation for foreign reference DE 20302434, obtained from http://translationportal.epo.org/emtp/translate/?ACTION=description-retrieval&Country=DE&ENGINE=google&FORMAT=docdb&KIND=U1&LOCALE=en_EP&NUMBER=20302434& OPS=ops.epo.org/3.2&SRCLANG=de&TRGLANG=en (last accessed on Dec. 7, 2017). (Year: 2017).*

(Continued)

*Primary Examiner* — Theodore V Adamos
(74) *Attorney, Agent, or Firm* — Schwegman Lundberg & Woessner, P.A.

(57) ABSTRACT

Installable temporary modular floor configured to be arranged on a surface to be protected so as to temporarily cover/face said surface. The floor comprises at least two panels, which are arranged side by side in adjacent positions, substantially coplanar to each other. The panels are provided on the relative sides with at least one recess that defines, with a corresponding recess made in one side of an adjacent panel, a seat. The floor also comprises at least one connecting plate, which is configured to be engaged in the seat to make the joint coupling of said panels.

15 Claims, 8 Drawing Sheets

(56) References Cited

U.S. PATENT DOCUMENTS 5,713,175 A * 2/1998 Mitchell ..... E01O 5/005 108/156
5,971,655 A * 10/1999 Shirakawa ..... E01C 5/005 404/34
6,189,289 B1 * 2/2001 Quaglia ..... E04F 15/024 52/126.4
6,669,572 B1 * 12/2003 Barlow ..... A63B 67/02 473/160
7,108,902 B2 * 9/2006 Ellingson ..... B32B 3/14 428/54
7,980,042 B2 * 7/2011 Polk, Jr. ..... B29C 31/047 403/252
8,205,407 B2 * 6/2012 Genova ..... E04B 5/026 403/335
2002/0078652 A1 * 6/2002 Hawkes ..... E01C 5/005 52/578
2003/0190969 A1 * 10/2003 Barlow ..... A63B 67/02 473/157
2003/0192275 A1 * 10/2003 He ..... E04F 13/10 52/403.1
2005/0102936 A1 * 5/2005 Chen ..... E04F 15/02405 52/263
2005/0241243 A1 * 11/2005 Wright ..... E01C 5/005 52/79.9
2006/0185303 A1 * 8/2006 Pacione ..... A47G 27/0468 52/582.1
2008/0250744 A1 * 10/2008 Hrovath ..... E04F 13/0801 52/582.1
2011/0179728 A1 * 7/2011 Cerny ..... E01O 5/001 52/177
2013/0019456 A1 * 1/2013 Heartsfield ..... A63B 6/00 29/525.03
2013/0167458 A1 * 7/2013 Cerny ..... E04F 15/02038 52/177

OTHER PUBLICATIONS

Dossier No. IO65485, Demand No. ITUA20164281, Search Report and Written Opinion dated Feb. 8, 2017, 7 pgs.

* cited by examiner

MODULAR PANELS FOR MAKING AN INSTALLABLE / REMOVABLE TEMPORARY FLOOR AND METHOD FOR MAKING SAID FLOOR

PRIORITY CLAIM

This application claims priority from Italian Patent Application No. 102016000059918 filed on Jun. 10, 2016, the disclosure of which is incorporated by reference.

TECHNICAL FIELD

The present patent application relates to modular panels for making an installable/removable temporary floor and a method for making said floor.

BACKGROUND

It is known that in order to protect the grass cover of a sports stadium, for example, a football stadium, during an event, in general, a music event, a walkable floor is temporarily placed over the cover to prevent it from being damaged by the people taking part in the event, walking on it.

This type of floor is generally installable/removable and is provided with a plurality of modular panels that can be connected to each other to form a walkable floor, which covers the surface to be protected. In use, before the event, the panels are positioned resting on the surface, side by side, touching each other, and they are jointly connected so that they can be dismantled after the event to free the surface below.

Patent EP 0 861 351 B1 describes a floor, for example, provided with flat, reinforcing panels for the ground, wherein a pair of parallel rectilinear edges of each panel are fitted, one with built-in female locking elements and, the other with corresponding male locking elements, protruding in the plane of the panel, to engage removably, in a vertical direction to the plane of the panel, with the female locking elements of an adjacent panel, so that they cannot be disengaged from the female locking elements in the horizontal plane of the panel. The first male and female locking elements of the panel are made in the form of prismatic pins provided with wings, and the second from corresponding prismatic recesses. They are made so that, when engaged, they make a limited relative rotation about an axis parallel to the adjacent sides of the panels, in such a way that they are hinged in an interlocking manner.

SUMMARY

If, on the one hand, the previously described panels are advantageous as they create a temporary floor that adapts to the changing inclinations of the resting surface and they can be assembled/dismantled quickly and cheaply, on the other, they present the technical problem of the protruding prismatic pins being subject to breakage/damage. Naturally, when a single prismatic pin of a panel is damaged, the use of the whole panel is compromised, with consequent replacement and disposal costs.

In this regard, the Applicant has carried out an in-depth study aimed at identifying a solution, which, on the one hand, preserves the advantages of the previously described panels, in other words their elevated adaptability to the resting surface and easy assembly/dismantling, while, on the other, overcoming the technical problem of said panels.

This objective is achieved with the present subject matter since it relates to a temporary modular floor and a method for making said modular floor.

BRIEF DESCRIPTION OF THE DRAWINGS

The present subject matter will now be described, with reference to the accompanying drawings, which illustrate a non-limiting embodiment, wherein.

DETAILED DESCRIPTION

The present subject matter is described in detail with reference to the accompanying Figures to allow an expert to make it and use it. Various modifications to the described embodiments will immediately be clear to experts and the general principles described can be applied to other embodiments and applications without going beyond the protective scope of the present subject matter, as defined in the accompanying claims. Consequently, the present invention must not be considered limited to the described and illustrated embodiments, but it must be granted the widest protective scope according to the principles and characteristics described and claimed herein.

Figure 1:
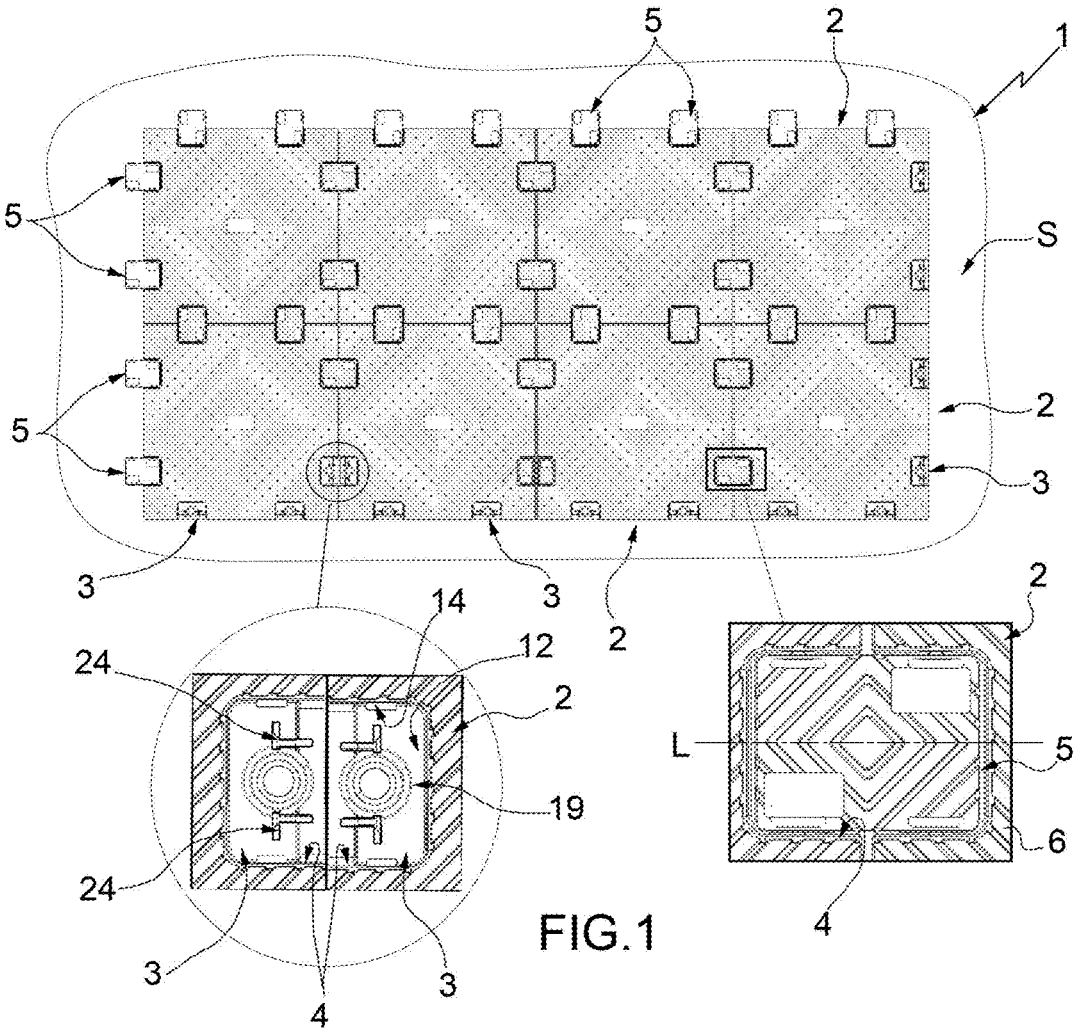
FIG. 1 is a schematic plan view, with enlarged parts for clarity, of an installable temporary modular floor, made according to the principles of the present subject matter.

With reference to FIG. 1, an installable/removable temporary floor (in other words of the type that is easy to remove), which can be walked on (shown only partially) and preferably used for sports events, music events or other similar events/occasions that is designed to be arranged on a surface S to be protected so that it is temporarily covered/faced, is globally indicated with number 1. The floor 1 is designed to be installed/assembled, before the event, resting on the surface S (ground) so that it covers/faces the surface S and protects it from being walked on and then it is dismantled after the event, to free/uncover the previously covered surface S. The floor 1 can preferably be used to protect, for example, a surface in a sports stadium (not illustrated), such as, for example, a surface S covered with grass, or a wooden parquet floor, or any other similar surface, which requires temporary protection during an event and/or is not suitable, in terms of safety, for being walked on by a considerable/significant number of people.

It is understood that the floor 1, concerning the present subject matter, is not limited to being specifically used for events, but it can be applied to other situations, where it is necessary to cover a surface temporarily to protect it from being walked on or from other elements associated with the surface, such as, for example, irrigation systems and/or heating systems immediately below the surface.

According to an embodiment shown in FIG. 1, the floor 1 comprises a plurality of tiles or panels 2, preferably square or rectangular, which are arranged side by side, in positions adjacent to and substantially coplanar with one another, in other words resting on corresponding sides of adjacent panels 2, provided with at least one recess 3, on each of the four sides, which defines, with a corresponding recess 3 made in one side of an adjacent panel 2, a seat 4. The floor 1 also comprises a plurality of connecting plates 5, each of which is designed to be coupled, in a stable, but easily removable manner, to a relative seat 4, which is preferably rectangular, to make the joint connection between the two adjacent panels 2 in order to create the floor 1.

Figure 2:
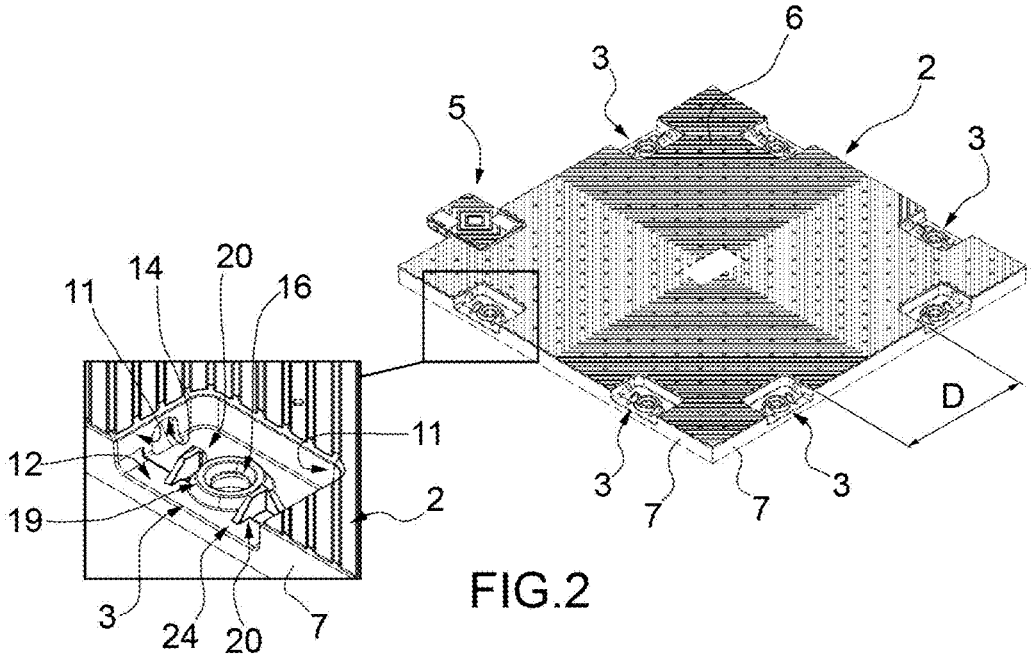
FIG. 2 is a perspective view, with enlarged parts for clarity, of a panel comprised in the installable modular floor shown in FIG. 1.
Figure 4:
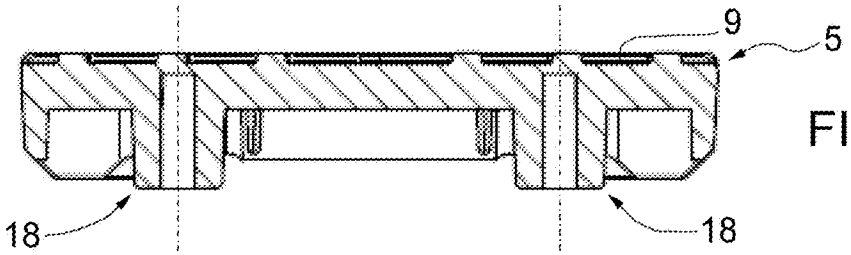
FIG. 4 is a longitudinal I-I section of the modular panel shown in FIG. 3.

With reference to FIG. 2, each panel 2 is substantially planar, preferably square or rectangular and has a plate-like body 6, whose flat upper surface defines (with the other panels) the upper walkable floor of the floor 1 and an external perimeter frame 7, which overhangs the external perimeter edge of the plate-like body 6 in a preferably orthogonal direction to the plane where the plate-like body lies and is designed, in use, for being positioned resting on the surface S to be covered/protected.

According to an embodiment shown by way of example in FIGS. 1 and 2, each panel 1 preferably has two recesses 3 on each of the four sides, which are spaced apart along the common side of a set distance D. If the panel 2 is square, as shown in the example in FIGS. 1 and 2, the pairs of recesses 3 made on the four sides preferably have the same joint distance D. In this way, when two panels 2 are aligned and positioned side by side, during assembly, the pair of recesses 3 on one side of a panel 2 conveniently auto-align with the pair of recesses 3 on any one of the four sides of an adjacent panel 2, forming the relative seats 4 without the panels 2 needing to be in any particular direction, thus simplifying their assembly. It is understood that there can be more than two recesses 3 on each side. It is also understood that if the panel 2 is rectangular, the number and/or distance of the recesses 3 made along the larger sides can be different from the number and/or respectively from the distance between the recesses 3 made along the smaller sides of the panel 2.

Instead, the connecting plates 5 are engaged "vertically" in relation to a lying plane of the floor 1, which, in use, is substantially horizontal as it generally corresponds to the resting surface S.

The connecting plates 5 are preferably rectangular and designed to be engaged manually, in a stable, but easily removable manner (as shown in FIGS. 8-12 and as subsequently described in detail), in the relative rectangular seats 4 along a direction A, which is substantially orthogonal to the plane on which the plate-like body 6 lies; they are provided with snap coupling members 8, which are designed, in turn, to be operated, during engagement, to make a snap coupling between the connecting plate 5 and the two adjacent panels 2, which are provided with recesses 3 forming the seat 4, to make the coupling between said panels 2.

Figure 5:
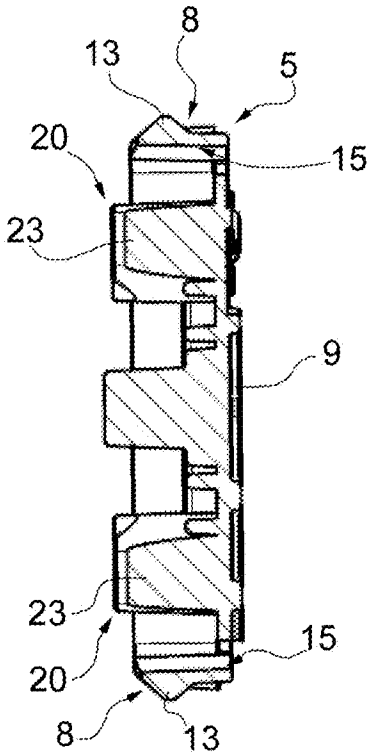
FIG. 5 is a transversal II-II section of the modular panel shown in FIG. 3.
Figure 3:
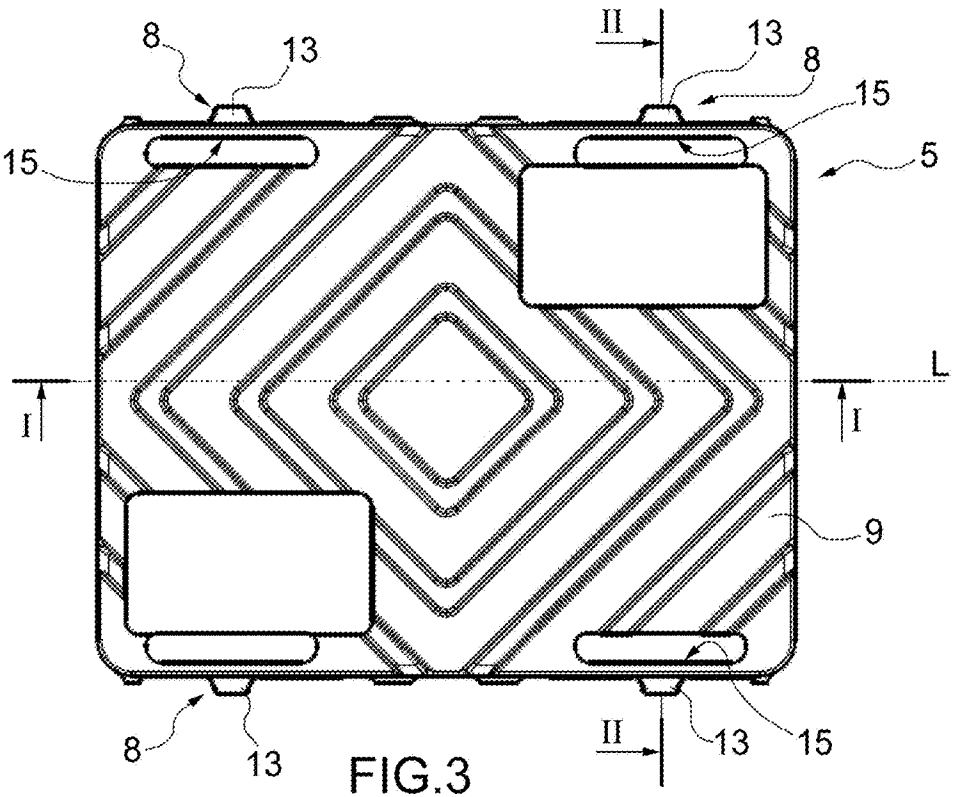
FIG. 3 is a schematic plan view, on an enlarged scale, of a connecting plate for the panels comprised in the installable modular floor shown in FIG. 1.
Figure 6:
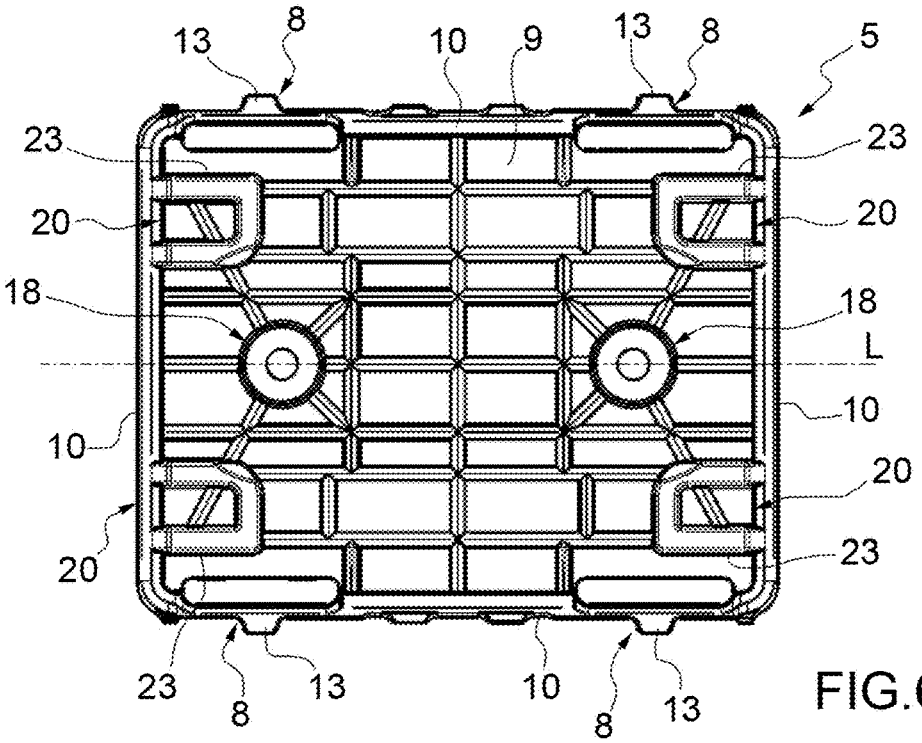
FIG. 6 is a schematic view from below of the connecting plate shown in FIG. 3.
Figure 7:
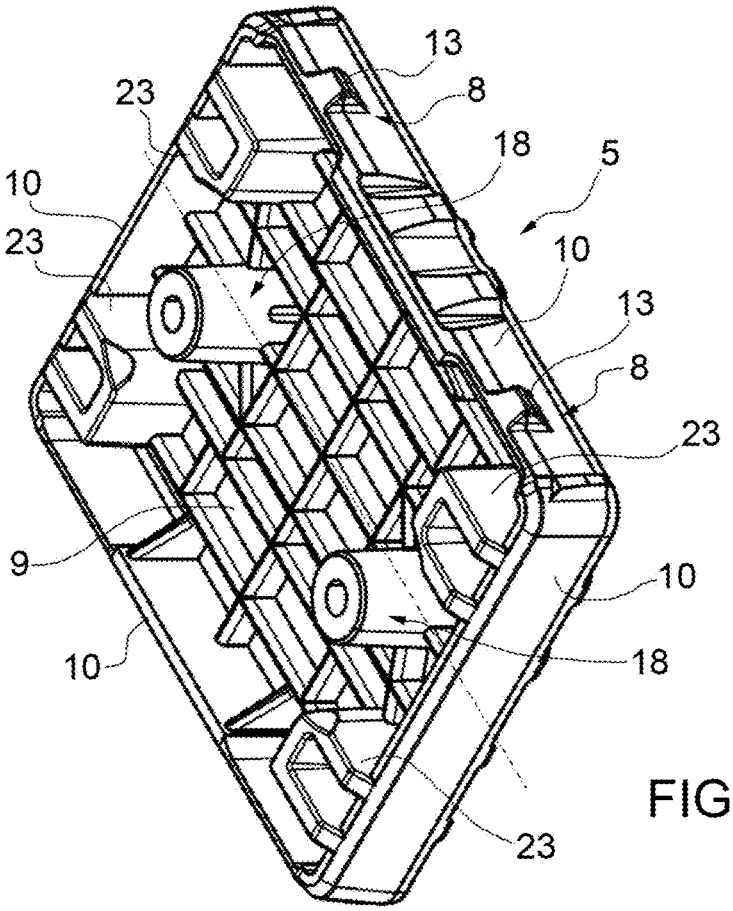
FIG. 7 is a perspective view from below of the connecting plate shown in FIG. 3.

According to an embodiment shown in FIGS. 3, 5 and 6, each connecting plate 5 comprises a rectangular-shaped flat sheet 9, which, in use, in other words after the coupling of the connecting plate 5 in the recess 3, lies on the same lying plane as the plate-like body 6 of the panel 2 so that the upper surface of the connecting plate 5 is substantially coplanar with the upper surface of the panel 2 forming the walkable surface of the floor 1.

Each connecting plate 5 also comprises an external perimeter frame 10, which surrounds the external perimeter edge of the sheet 9 and overhangs the lower surface of the latter so that it is positioned substantially orthogonal to the sheet and preferably the reinforcing safety edges, which extend orthogonally to the sheet 9 and develop in preferably parallel and/or orthogonal directions to the L axis.

The perimeter frame 10 of the connecting plate 5, in use, is substantially arranged close to the walls 11 (vertical in FIG. 2) of the recesses 3 that laterally delimit the rectangular seat 4, with the lower edge/corner resting/abutting on the bottom wall 12 of the recesses 3 forming the seat 4.

According to an embodiment shown by way of example in Figures from 3 to 6, the snap coupling members 8 of each rectangular connecting plate 5 comprise two pairs of lateral teeth 13 that protrude from the outer surfaces of two parallel sides of the perimeter frame 10 of the connecting plate 5, and which are designed, in use, for snap coupling to two corresponding pairs of openings 14 made on the parallel walls 11 of the seats 4 (FIG. 2).

According to an embodiment shown by way of example in Figures from 3 to 6, the two pairs of teeth 13 are positioned on the respective larger sides opposite the connecting plate 5 specularly/symmetrically to each other in relation to the longitudinal axis L, so that each tooth 13 on a larger side is aligned with an opposite tooth 13 on the other larger side, along a common axis orthogonal to the L axis.

In the example shown, the two teeth 13 on each larger side of the connecting plate 5 are positioned approximately at the longitudinal ends opposite the connecting plate 5, so that the opposite and aligned pairs of teeth 13 on the ends engage in the respective pairs of openings 14 in the relative two recesses 3, arranged side by side, forming the seat 4.

In the illustrated example, each seat 4 comprises two pairs of openings 14, which are each made on a relative recess 3 to house the opposite, aligned teeth 13 on the end of the connecting plate 5. The internal walls 11 of each recess 3 preferably have an internal portion, which, in use, is orthogonal to the L axis of the connecting plate 5 and two lateral portions parallel to the L axis, facing each other, where the two openings 14 that house the teeth 13 are made.

According to an embodiment shown in FIG. 5, the teeth 13 can have an orthogonal section in relation to about the triangular L axis. Instead, as shown in FIG. 3, a through eyelet or slot 15 can be made on the upper sheet 9, next to each tooth 13, i.e. on the perimeter edge that extends straight, preferably parallel, to the L axis and which is dimensioned in such a way that, in use, during engagement, the portion of perimeter frame supporting the tooth 13 bends elastically towards the inside of the connecting plate 5 under the pressure of the tooth 13 and then returns elastically to the initial position when the tooth 13 engages in the opening 14. It is understood that the four slots 15 conveniently define four respective flexible wings on the perimeter frame 10, which support the teeth 13 and allow the teeth to make a limited movement (by a few millimeters) transversal to the L axis that causes the engagement in the corresponding opening 14.

It is also understood that slots 15 can be made, alternatively, or in addition, on the plate-like body 6 immediately above the openings 14. In this case, during engagement, the portion of wall 11 next to the slots 15 above the opening 14 tends to flex under the pressure of the tooth 13 further assisting its engagement in the opening 14.

According to an embodiment shown by way of example in FIGS. 1 and 2, the recesses 3 are provided on the outer perimeter edge of the panel 2 and are provided with circular through openings made on the bottom walls 12 of the recesses 3, to be engaged by corresponding stems or hubs 18 of the connecting plates 5. The circular through openings 16 and the corresponding hubs 18 are preferably designed for being engaged, in turn, by corresponding clamping screws 17 (shown in FIGS. 8, 11 and 12), which create a stable and substantially rigid fixing of the connecting plates 5 to the panels 2.

According to an embodiment shown by way of example in FIGS. 2, 4, 5 and 6, the connecting plate 5 comprises two hubs 18, which overhang the lower surface of the sheet 9 along relative axes orthogonal to the sheet so as to position, in use, the corresponding free ends resting/abutting on corresponding collars 19 on the bottom wall 12 of the recesses 3. In the illustrated example, the two hubs 18 of the connecting plate 5 are arranged parallel to each other, at a set distance from each other, so that they lie on a parallel plane to the L axis, while each collar 19 is arranged on the bottom wall 12 of the recess 3, in a coaxial position with the circular opening 16, so that it can be crossed, in use, by the stem of the clamping screw 17. The collar 19 can also preferably have a substantially self-centering tapered shape designed to favour the positioning of the hub 18 in the central concavity of the collar 19 so as to make the connecting plate 5 adopt the correct engagement position in the recess 3 and, at the same time, align the internal passage, preferably, but not necessarily threaded, of the hub 18 with the circular opening 16.

According to an embodiment shown in FIGS. 1, 2, 5, 6 and 7, the connecting plates 5 and the recesses 3 are also provided with stop members 20, which are designed to prevent the connecting plate 5, when engaged in the recesses 3, from moving inside the seat 4 along a direction parallel to the longitudinal axis L.

According to an embodiment shown by way of example in FIGS. 1, 2, 5, 6 and 7, the stop members 20 can comprise two pairs of protruding elements, in other words teeth 23, preferably rectangular, which are positioned on the connecting plate 5, preferably at respective longitudinal ends opposite the connecting plate 5, i.e. next to the two smaller sides of the plate, and are designed, in use, for abutting on a respective pair of shoulders 24 (shown in FIGS. 1 and 2) positioned on the bottom wall 12 of the recess 3.

According to an embodiment shown by way of example in FIGS. 1 and 2, the two shoulders 24 overhang the bottom wall 12 and are positioned next to the circular opening 16 and the collar 19 by opposite bands, in symmetrical positions in relation to the middle plane of the recess 3. Each shoulder 24 can comprise, for example, a substantially T-shaped profile, which has a smaller plate-like portion. Resting on this, in use, is a supporting face of a tooth 23 of the plate-like body 6 and a larger plate-like portion, which extends centrally from the relative smaller plate-like portion along a direction orthogonal to the same, designed for reinforcing the shoulder 24.

In the illustrated example, the smaller plate-like portions of the two shoulders 24 in the recess 3 can lie on a same plane, which is preferably parallel to the internal portion of the walls 11 delimiting the recess 3 so that they are positioned, in use, abutting on the internal faces of the teeth 23.

To assist assembly, the connecting plate 5 and the recesses 3 can preferably be dimensioned in such a way that the width of the recess 3, measured along a direction orthogonal to the L axis, rounds up the width of the connecting plate 5, measured along a direction orthogonal to the L axis, and that the overall length of two recesses 3, arranged side by side, measured along a direction parallel to the L axis, rounds up the length of the connecting plate 5, measured along a direction parallel to the L axis.

The two openings 14 of the recess 3 designed to house the teeth 13 are made on the two relative walls 11 of the recess 3, which extend parallel to each other, and to the longitudinal axis L of the plate 5, in symmetrical positions in relation to the middle plane of the recess 3 so that they are facing each other.

According to an embodiment, the openings 14 have a substantially rectangular shape and a height measured along a direction orthogonal to the bottom wall 12, which is greater than the height of the tooth 13 measured along a direction orthogonal to the sheet 9. In this way, the tooth 13 can make millimetric vertical movements, orthogonal in relation to the bottom wall 12 of the recess 3, inside the opening 14 while remaining trapped inside the opening. Each opening 14 preferably has a width measured along a direction parallel to the L axis that is greater than the thickness of the tooth 13 measured along the same direction. In this way, the tooth 13 can make millimetric longitudinal movements inside the opening 14 while staying trapped inside the opening. The openings 14 can also preferably have rounded upper vertices, opposite the bottom wall, to facilitate the disengagement of the teeth 13 from the openings 14.

The panels 2 and the connecting plates 5 can preferably be made of a plastic material by means of injection moulding, thermoforming or a similar process. The panels 2 and the connecting plates 5 can preferably be made, for example, of copolymer polypropylene.

The method for making the floor 1 is described below, with reference to FIGS. 8 to 12. In particular, the operating steps carried out for coupling two panels 2 with a single connecting plate 5 will be illustrated and described to clarify the explanation of the present subject matter. It is understood that the same operations are also repeated in the same way for engaging the remaining connecting plates 5 used to make the floor 1.

Figure 8:
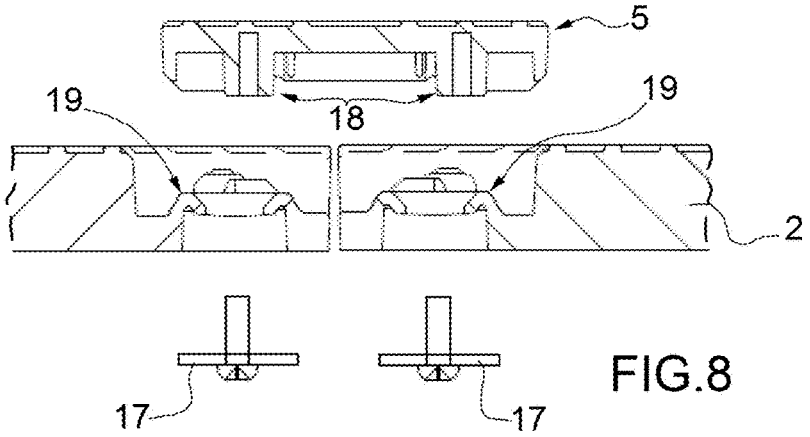
FIGS. 8, 9, 10, 11, through 12 show vertical sections, with enlarged parts for clarity, of two adjacent panels and the relative connecting plate, which illustrate the operations carried out by the method for making the floor according to the principles of the present subject matter.
Figure 9:
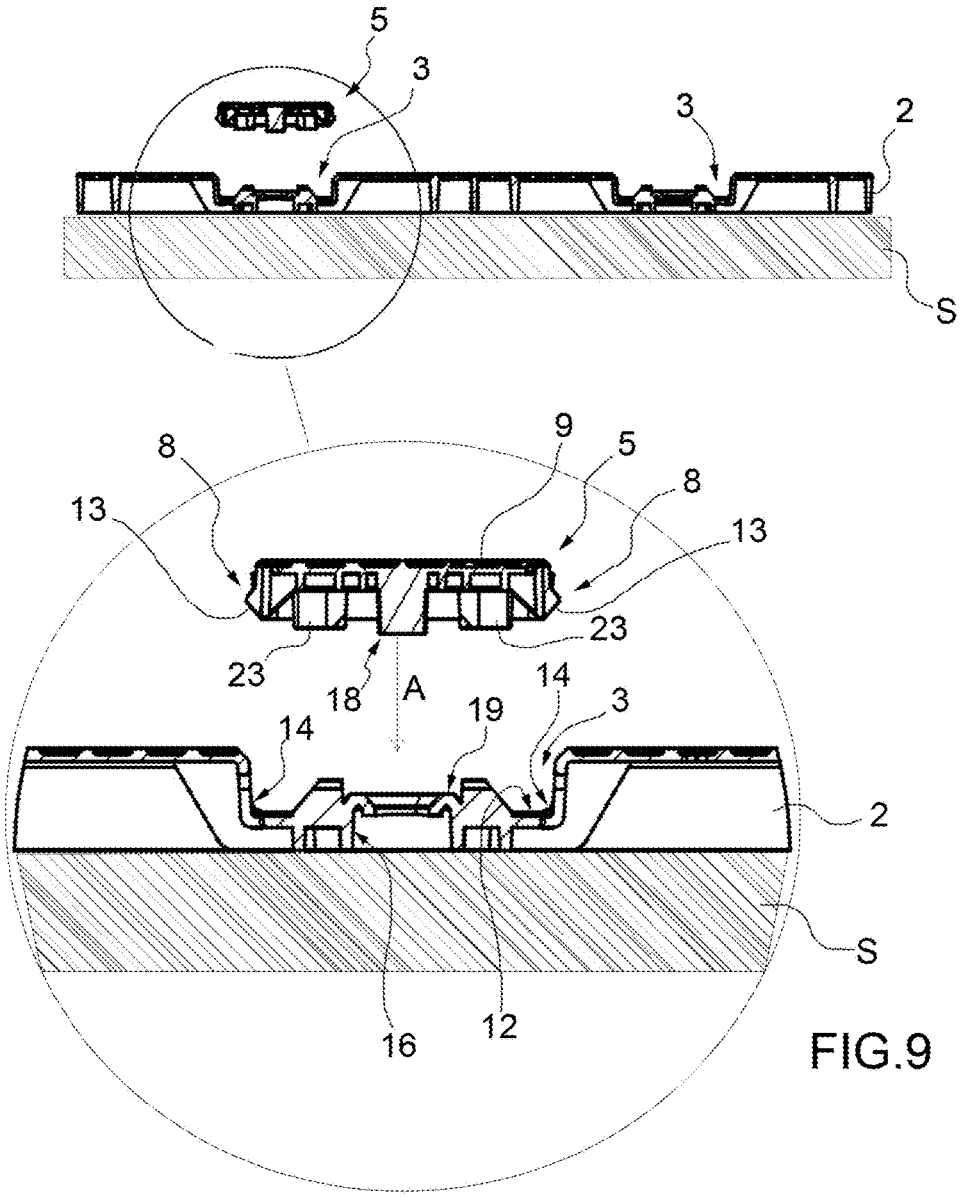
Figure 10:
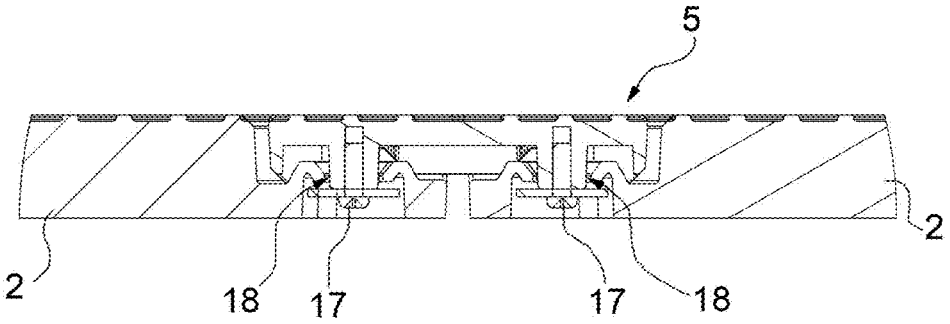
Figure 11:
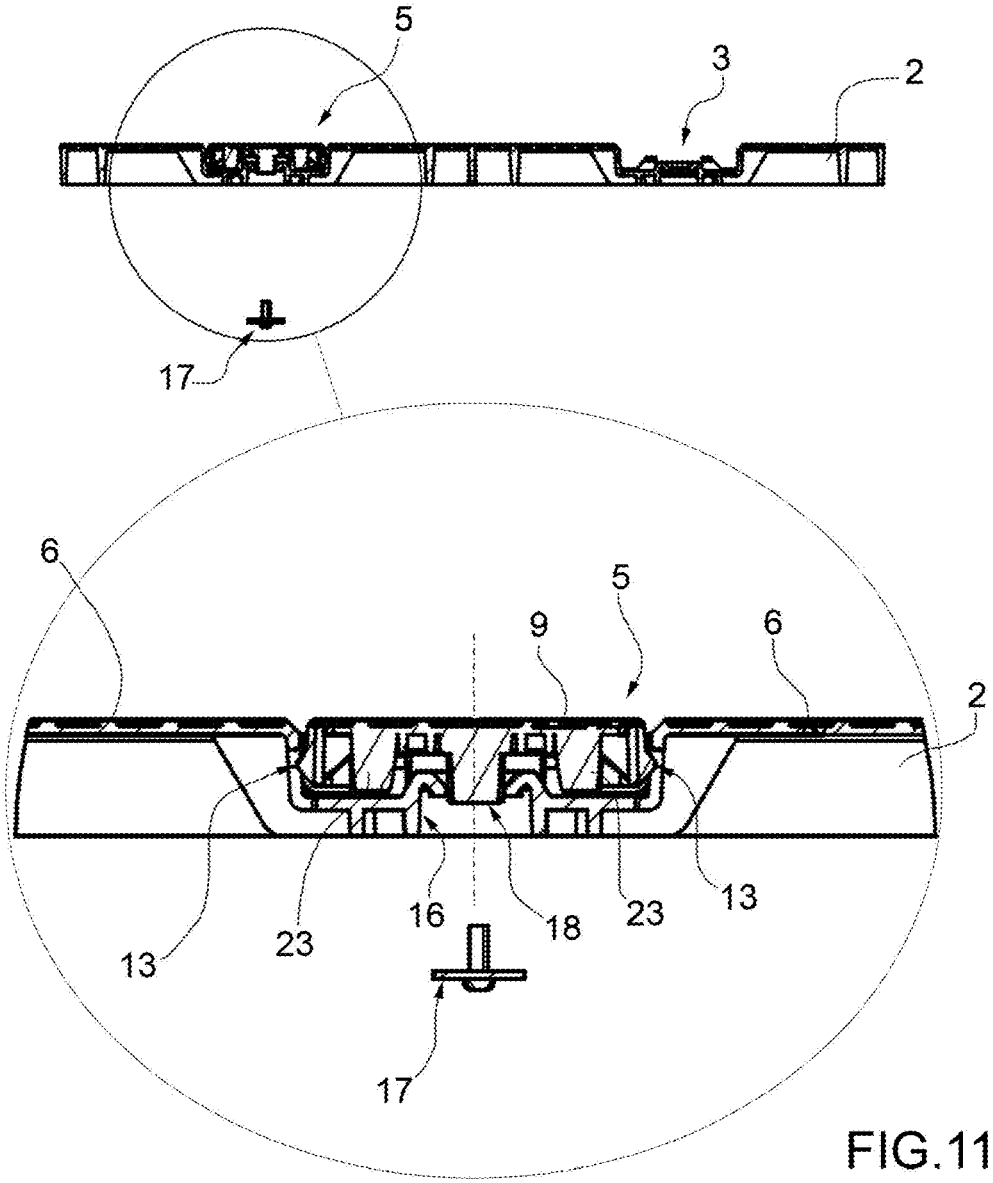
Figure 12:
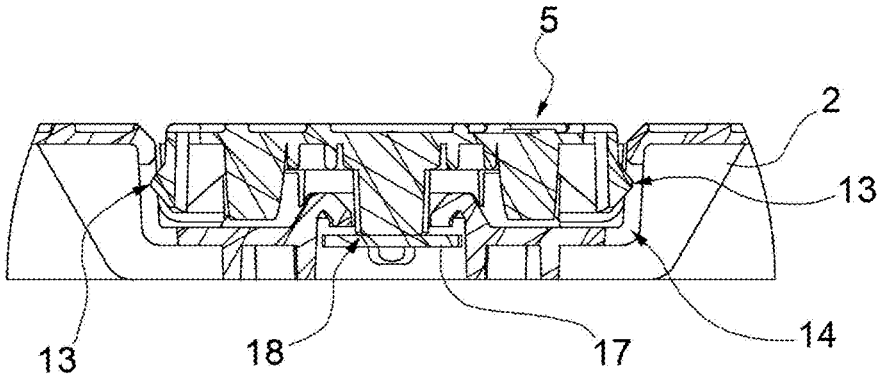

With reference to FIG. 8, the method comprises the steps of arranging at least one pair of panels 2, resting on the surface S (horizontal in FIG. 8), in such a way as to position the side of an adjacent panel 2, which is preferably resting/abutted on/against the side of the other panel 2, bringing the recesses 3 together and making the seat 4; positioning the connecting plate 5 above the seat 4 made up of the two adjacent recesses 3, preferably keeping the connecting plate 5 on a plane almost parallel to the panels 2; moving the connecting plate 4, preferably keeping it on the plane parallel to the panels 2, along a direction A, which is substantially orthogonal to the panels 2, so that the hubs 18 are resting on the collars 19 and, at the same time, the two pairs of teeth 13 engage in the corresponding pairs of openings 14 in the two adjacent recesses 4 (FIG. 12). During engagement of the connecting plate 5 in the seat 4, the teeth 13 bend slightly towards the inside of the connecting plate 5 thanks to the portions of wings in the frame 10 and snap couple in the respective openings 14 consequently making the connection between the two panels 2. In this phase, the teeth 23 of the connecting plate 5 are arranged abutting on the shoulders 24, contrasting their longitudinal movement.

Preferably, but not necessarily, the method also comprises the step of engaging the stem of the clamping screws 17 in the circular openings 16 in the bottom wall 12 of the recesses 3, and screwing the screws in the internal passages of the hubs 18, to fix the connecting plate 5 stably to the two panels 2, making the stable connection between said panels.

Figure 13:
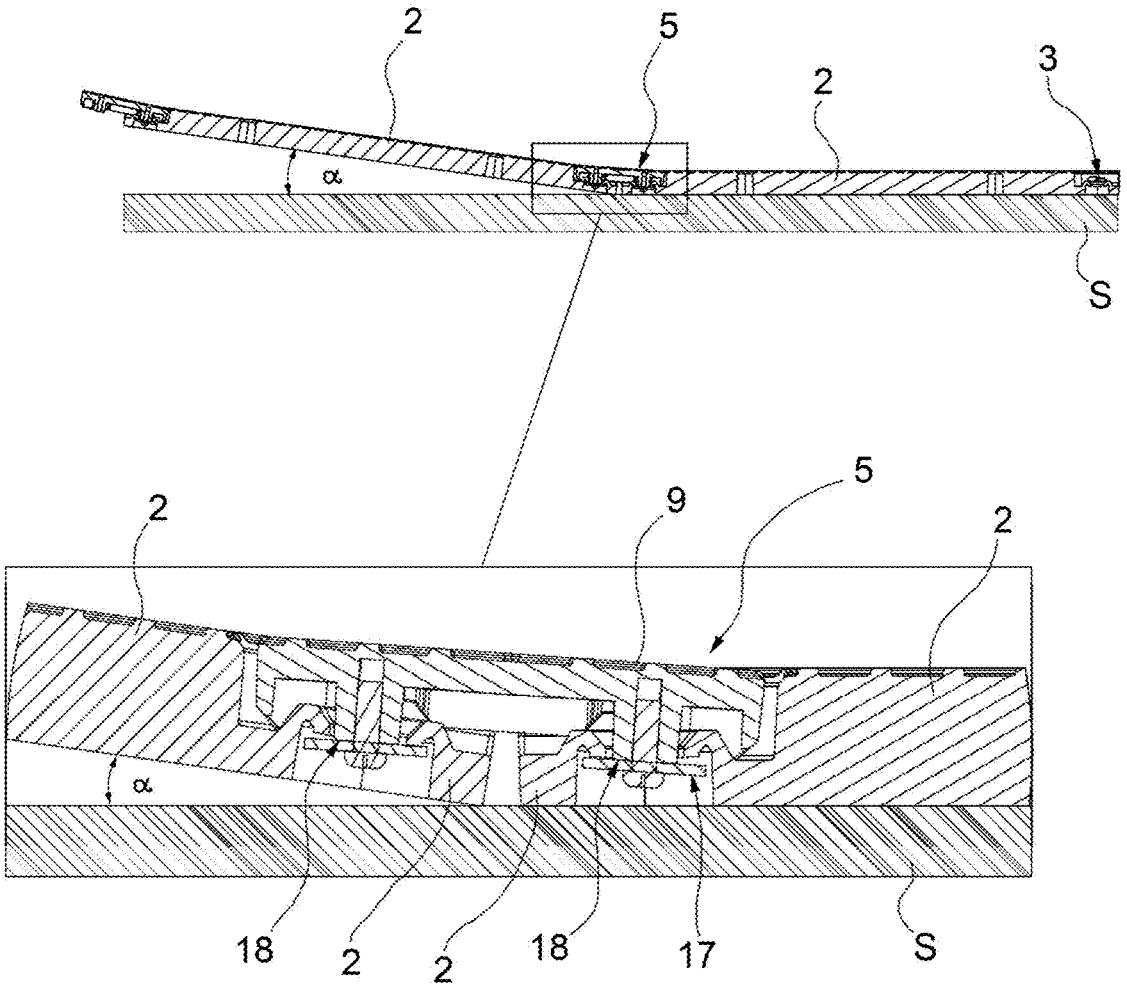
FIG. 13 shows the angle of inclination of a panel connected to an adjacent panel by means of the connecting plate.
Figure 14:
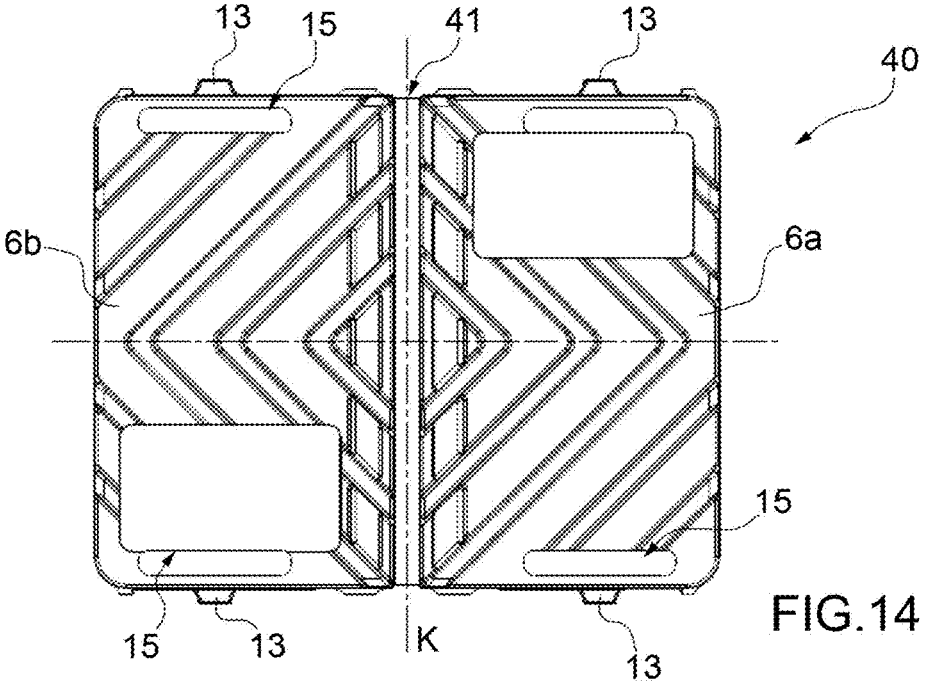
FIG. 14 shows a plan view of a connecting plate made according to a variation of the present subject matter.
Figure 15:
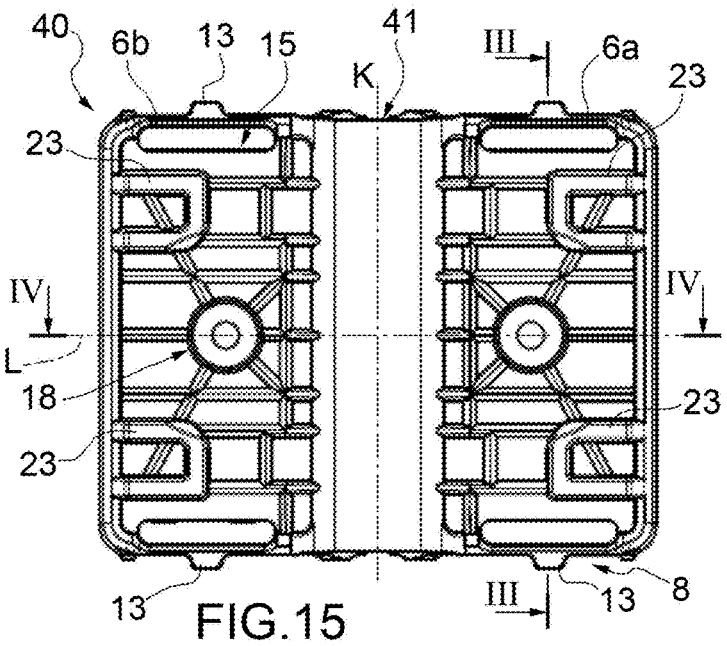
FIG. 15 shows a view from below of the connecting plate shown in FIG. 14.
Figure 16:
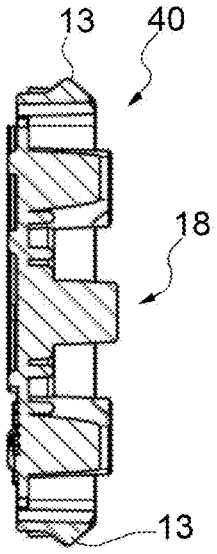
FIG. 16 is a III-III section of the connecting plate shown in FIG. 15.
Figure 17:
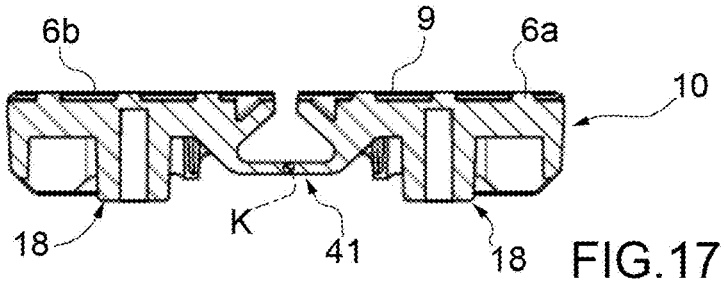
FIG. 17 is a IV-IV section of the connecting plate shown in FIG. 15.
Figure 18:
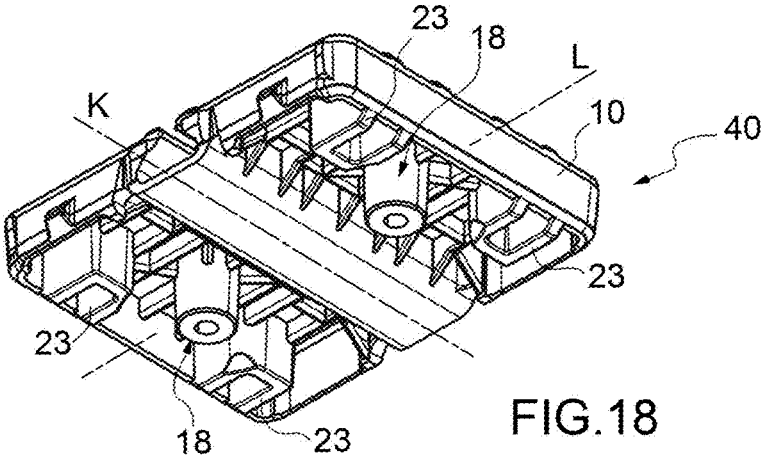
FIG. 18 shows a perspective view of the connecting plate shown in FIG. 15.

With reference to FIG. 13, it should be pointed out that, thanks to the teeth 23 being able to move in the relative openings and thanks to the play between the perimeter frame 10 of the plate and the internal walls 11 of the seat 4, the connecting plate 5 can be moved longitudinally until the teeth 23 are positioned abutting on the shoulders 24 and can, therefore, rotate partially about the axis, passing through the two aligned teeth 23. In this way, the connecting plate 5 allows the panels 2 to be inclined in relation to each other by a maximum set angle $\alpha$ without the plate 5 disengaging 5 from the seat. The set angle of inclination a of the adjacent panels 2 can preferably be comprised between about 70 and about 120, preferably 100. Thanks to this, the floor 1 can conveniently adapt to irregular surface profiles.

Figure 19:
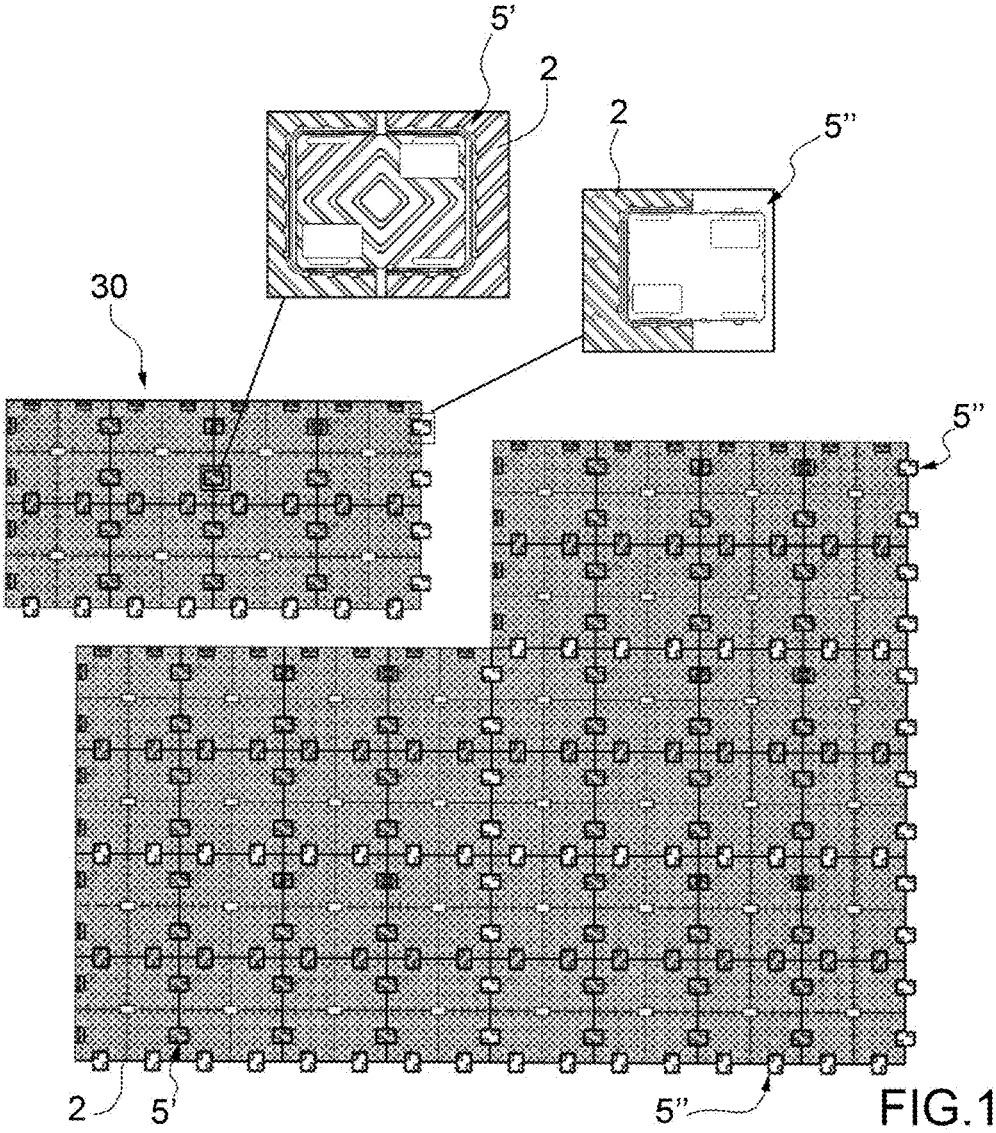
FIG. 19 shows a view from above, with enlarged parts for clarity, of a portion of floor and a modular planar preassembly used in a variation of the method provided according to the present subject matter.

With reference to FIG. 19, the method can also comprise the steps of: making modular planar pre-assemblies 30, before laying the floor 1 on the surface S, (one of which is shown at the top, on the left in FIG. 19), each comprising a plurality of panels 2, preferably eight panels 2, arranged on two parallel rows connected by four panels 2, each forming a rectangular walkable floor, and a plurality of first internal connecting plates, indicated by number 5' in FIG. 19, which stably fix the facing/connected sides of the panels 2, forming the modular planar pre-assembly 30, with clamping screws 17, and a series of second connecting plates, indicated by number 5" in FIG. 19, which are engaged and fixed stably with the clamping screws 17, in the recesses 3, on a larger external side and on a smaller external side of the pre-assembly. The two remaining larger and smaller sides of the pre-assembly 30 having recesses 3 free of plates.

The method also comprises the step of juxtaposing the side of a modular planar pre-assembly 30, which has the second connecting plates 5" with the side of an adjacent modular planar pre-assembly 30 having free recesses 3 so as to snap couple the free ends of the second connecting plates 5" in the recesses, without screwing the clamping screws 17 in the portions of said plates, which engage in the recesses 3. The second connecting plates 5" can preferably be made so that they differ visually during the operations of dismantling. For this purpose, as shown, for example, in FIG. 19, the second connecting plates 5" can be made with a surface finishing (for example smooth or with elevations) and/or a colour (for example red) different to the finishing and/or colour respectively of the first connecting plates 5'.

Thanks to said connecting plates, the previously described floor makes it possible, on the one hand, to increase the speed of assembling/dismantling the panels, with a consequent reduction in costs and, on the other, to significantly limit the costs associated with maintaining/disposing of the panels in the event of breakage, as they are substantially limited to replacing the connecting plates, and do not require the replacement of the whole panel, as is the case with the currently adopted solutions.

Finally, it is clear that modifications and variations can be made to the floor and to the method described and illustrated above, without going beyond the scope of the present invention defined by the accompanying claims.

The embodiment illustrated in FIGS. 14 to 18 relates to a connecting plate 40, which is similar to the connecting plate 5 shown in FIGS. 3 to 7, whose portions/components are distinguished, where possible, by the same reference numbers that distinguish corresponding portions/components of the connecting plate 5 described above. The connecting plate 40 differs from the connecting plate 5 in that the plate-like body 6 is subdivided into two substantially identical, rectangular semi-portions **6*a* and 6*b*, which are connected centrally, i.e. along two sides connected by a central fold portion 41, which extends along a K axis orthogonal to the L axis, at the central area of the supporting plate-like element 6, and is designed to allow the two semi-portions 6*a* and 6*b* to rotate partially about the W axis, in relation to each other, in order to increase the set angle of inclination a between the panels 2. The central fold portion 41 can preferably have a thin strip of deformable/bendable material, which extends almost parallel to the upper surface of the two portions 6*a* and 6*b* along a substantially orthogonal direction to the longitudinal axis L. It is understood that the floor 1 and/or modular planar pre-assemblies 30 can comprise one or more connecting plates 5 and/or, in addition or alternatively, one or more connecting plates 40**.

The invention claimed is:

1. An installable temporary modular floor configured to be arranged resting on a surface to be protected so as to temporarily cover or face said surface, said floor comprising:

at least two square or rectangular panels, which are arranged side by side in adjacent positions and substantially coplanar to each other and are provided on each relative side with at least one recess, which defines, with a corresponding recess made on one side of an adjacent panel, a rectangular seat, a connecting plate configured to be engaged in said seat to mutually couple said panels, and wherein said connecting plate is shaped so as to be manually engaged in a stable, but removable manner, in said seat along a direction substantially orthogonal to a plane on which the panels lie and is provided with snap coupling members configured to be operated, during engagement, to make a snap coupling between the connecting plate and said panels;

said connecting plate comprising:

a rectangular-shaped flat sheet, which lies on the plane on which the panels lie so that an upper surface of the connecting plate is substantially coplanar with an upper surface of the panels forming a walkable surface of the floor; and a rectangular external perimeter frame, which surrounds an external perimeter edge of the rectangular-shaped flat sheet and overhangs a lower surface of the rectangular-shaped flat sheet so that the rectangular external perimeter frame is positioned substantially orthogonal to the sheet and is substantially arranged close to walls of the recesses that laterally delimit the rectangular seat, with a lower edge of the rectangular external perimeter frame resting or abutting on a bottom wall of the recesses forming the seat;

said snap coupling members comprising two pairs of lateral teeth which protrude from outer surfaces of two parallel sides of the external perimeter frame of the connecting plate, and are designed for snap coupling to two corresponding pairs of openings made on parallel walls of the seats; and said two pairs of lateral teeth being positioned on the respective larger sides of the connecting plate symmetrically to each other in relation to the longitudinal axis of the connecting plate, so that each tooth on a respective larger side is aligned with an opposite tooth on the other larger side along a common axis orthogonal to the longitudinal axis.

2. The floor according to claim 1, wherein said connecting plate comprises two hubs, which extend along respective axes orthogonal to said connecting plate in such a way as to arrange, in use, respective free ends of the two hubs resting or abutting on corresponding collars on the bottom wall of said recesses.

3. The floor according to claim 2, wherein said recesses are provided with circular through openings made on said bottom walls of said recesses to be engaged by said hubs of the connecting plate.

4. The floor according to claim 3, wherein said circular through openings and the corresponding hubs are configured to be engaged by corresponding clamping screws that make a stable and substantially rigid fixing of the connecting plate to said panels.

5. The floor according to claim 2, wherein the collars have a substantially self-centering tapered shape designed to favor positioning of the hub in a central concavity of the collars so as to make the connecting plate adopt a correct engagement position in the recess and, at the same time, align an internal threaded passage of the hub with a circular opening of a respective collar.

6. The floor according to claim 1, wherein the connecting plate and the recesses are provided with stop members configured to limit or stop the movement of the connecting plate inside said seat along a direction parallel to the longitudinal axis of said connecting plate.

7. The floor according to claim 6, wherein said stop members comprise two pairs of rectangular teeth, which are positioned at respective longitudinal ends opposite the connecting plate, and are designed, in use, for abutting on a respective pair of shoulders positioned on the bottom wall of the recess.

8. The floor according to claim 7, wherein said shoulders overhang said bottom wall and are positioned next to a circular opening and the collars by opposite bands, in symmetrical positions in relation to a middle plane of the recess.

9. The floor according to claim 8, wherein said shoulders comprise a substantially T-shaped profile, which has a smaller plate portion; resting on the smaller plate portion, in use, is a supporting face of a respective stop member of the connecting plate and a larger plate portion, which extends centrally from the relative smaller plate portion along a direction orthogonal to the smaller plate portion, designed for reinforcing the shoulder.

10. The floor according to claim 1, wherein the connecting plate has a central fold portion, which extends along a rotation axis orthogonal to the longitudinal axis of the connecting plate designed to allow a first portion of the connecting plate to rotate partially about the rotation axis in relation to a second portion of the connecting plate.

11. The floor according to claim 1, wherein said rectangular-shaped flat sheet comprises a through slot placed next to each tooth, each slot extends straight parallel to said longitudinal axis and is dimensioned in such a way that, in use, during engagement, a portion of the perimeter frame supporting each respective tooth bends elastically towards an inside of the connecting plate under a pressure of the tooth and then returns elastically to an initial position when the tooth engages in a respective opening.

12. The floor according to claim 11, wherein said rectangular-shaped flat sheet comprises four through slots which define four respective flexible wings on the perimeter frame, which support the teeth and allow the teeth to make a limited movement transversal to said longitudinal axis that causes the engagement in the corresponding opening.

13. The floor according to claim 1, wherein said connecting plate and the recesses are dimensioned in such a way that a width of the recess, measured along a direction orthogonal to the longitudinal axis, rounds up a width of the connecting plate, measured along a direction orthogonal to the longitudinal axis, and that an overall length of two recesses, arranged side by side, measured along a direction parallel to the longitudinal axis, rounds up a length of the connecting plate, measured along a direction parallel to the longitudinal axis.

14. The floor according to claim 1, wherein said two openings of each recess are made on two walls of the recess, which extend parallel to each other, and to the longitudinal axis of the connecting plate, in symmetrical positions in relation to a middle plane of the recess so that the openings are facing each other.

15. The floor according to claim 1, wherein the openings have a substantially rectangular shape and a height measured along a direction orthogonal to the bottom wall, which is greater than the height of the tooth measured along a direction orthogonal to the sheet.

* * * * *